United States Patent [19]

Pätzold et al.

[11] 4,455,359

[45] Jun. 19, 1984

[54] TAMPER-PROOF DOCUMENT

[75] Inventors: Walter Pätzold; Werner Verburg; Harald von Rintelen, all of Leverkusen, Fed. Rep. of Germany

[73] Assignee: Agfa-Gevaert Aktiengesellschaft, Leverkusen, Fed. Rep. of Germany

[21] Appl. No.: 401,654

[22] Filed: Jul. 26, 1982

[30] Foreign Application Priority Data

Jul. 30, 1981 [DE] Fed. Rep. of Germany ..... 3130032

[51] Int. Cl.[3] ..... G03C 3/00

[52] U.S. Cl. ..... 430/10; 40/626; 40/630; 283/77; 283/108; 283/112; 283/904; 428/206; 428/916

[58] Field of Search ..... 430/10, 12, 950, 961; 428/199, 916, 200, 206; 283/77, 108, 112, 904; 40/626, 630; 427/7; 156/230, 241

[56] References Cited

U.S. PATENT DOCUMENTS

| | | | |
|---|---|---|---|
| 2,322,037 | 6/1943 | Lindquist | 430/539 |
| 3,520,768 | 7/1970 | Peilstocker | 161/125 |
| 3,635,853 | 1/1972 | Wiest | 260/8 |
| 3,647,442 | 3/1972 | Maister | 430/10 |
| 3,654,022 | 4/1972 | Wiest | 156/320 |
| 3,871,119 | 3/1975 | Mayer | 283/112 |
| 4,096,015 | 6/1978 | Kawamata et al. | 428/916 |
| 4,133,926 | 1/1979 | Vorrier et al. | 428/916 |
| 4,142,894 | 3/1979 | Hori | 96/63 |
| 4,184,701 | 1/1980 | Franklin et al. | 283/108 |
| 4,264,719 | 4/1981 | Kameoka et al. | 430/950 |
| 4,367,284 | 1/1983 | Cellone et al. | 430/950 |

*Primary Examiner*—J. Travis Brown

*Attorney, Agent, or Firm*—Connolly & Hutz

[57] ABSTRACT

The tamper-proof document consists of a photographic material as information carrier comprising front- and back gelatine layers, the outer of the gelatine layers of which contain particles of a homo- or copolymer of an acrylic and/or methacrylic acid ester. The information carrier is laminated on one or both sides to a transparent foil by means of a hardenable adhesive. The document is remarkably safe against falsification.

10 Claims, No Drawings

TAMPER-PROOF DOCUMENT

This invention relates to a photographic information carrier laminated with plastics foils on one or both sides.

Tamper-proof documents are becoming increasingly important. They are used, for example, in the form of credit cards for banks, retail stores, oil companies, air lines or credit companies to facilitate cash-free transactions. Such documents contain information relating to the owner and to the authority issuing the document and should in the interests of both parties be secured against falsification. There has therefore been no lack of attempts to make such information carriers tamper-proof.

It is known, for example, to secure a card carrying printed information by enclosing it between two foils. The laminating foil is in this case prepared in certain areas so that it will not adhere to the surface of the paper in these areas. Any attempt subsequently to strip off the laiminating foil will then cause the paper to be torn off with the foil in the areas which have not been so prepared since the force of the pull will be transferred to the less resistant paper surface (German Offenlegungsschrift No. 2,511,367).

According to another proposal, a printed information carrier consisting of a paper card with an edge of foil, a so-called "composite inlet", is welded between two clear foils. In this case, the foil border acts as a weld sealing the edges of the paper card so that the card is more difficult to split open (German Offenlegungsschrift No. 2,756,691).

According to British Pat. No. 1,518,946, a photographic paper used as an information carrier is welded into a pair of transparent laminated foils by the application of pressure and temperature round the edges. The foils used for this purpose are ordinary commercial foils consisting of an outer layer of polyethylene terephthalate and an inner layer of polyethylene.

One disadvantage of the known laminating processes is that, when the laminating foils are welded, they are bonded only incompletely to the surface of the information carrier and therefore provide only limited protection against falsification. Welding round the edges does not provide any substantial improvement under these conditions since the weld can easily be removed and replaced. The known laminating processes have the further disadvantage that the laminating foil can be separated from the paper layer by heating or by chemical means.

It is an object of the present invention to provide a tamper-proof document comprising an information carrier in the form of a photographic material to which information has previously been applied either photographically or by printing and in which the whole surface thereof is indissolubly attached to a transparent foil, and the information applied to the information carrier is no longer accessible without destruction of the information carrier and is therefore safely protected against subsequent alteration.

The present invention thus provides a tamper-proof document consisting of an information carrier in the form of a photographic material carrying information and laminated on one or both sides to at least one transparent foil by means of a layer of adhesive, the document being characterized in that the information carrier comprises at least one gelatine layer carrying a photographic silver or dye image, optionally an outer gelatine-containing protective layer applied to the emulsion side and an outer gelatine-containing layer applied to the back, at least the outer of the gelatine-containing layers containing particles less than 0.1 μm of a homo- or copolymer of an acrylic and/or methacrylic acid ester. These homo- or copolymers may also contain small quantities, e.g. up to 10 mol % of other comonomers in a polymerised form. When choosing these additional components, however, care should be taken to ensure that the polymer remains substantially insoluble in water.

The homo- or copolymers of acrylic and/or methacrylic acid esters (hereinafter briefly referred to as polymers) which are contained in the gelatine layers of the information carrier are based on aliphatic $C_1$ to $C_{12}$ esters. To prepared the gelatine layers, the polymers are added to the casting solutions in the form of latices which may be prepared by well known methods with a solids content of from 20 to 60% by weight and a particle size below 0.1 μm. Particles measuring from 0.01 to 0.07 μm are preferred for the present purpose. The methyl, ethyl and butyl esters are particularly suitable. Ethyl esters are preferred, and in particular polyethyl acrylate.

In order to make the surface more suitable for printing or writing on, the gelatine layers, in particular the outer layers of the information carrier, may contain matting agents, e.g. inorganic matting agents such as silicon dioxide, titanium dioxide, magnesium oxide, aluminium oxide, barium sulphate, calcium carbonate or glass powder, or organic matting agents such as starch, cellulose esters, e.g. cellulose acetate propionate, cellulose ethers, e.g. ethyl cellulose, or synthetic products such as homopolymers or copolymers, e.g. of vinyl acetate or vinyl carbonate or esters of acrylic and methacrylic acid, e.g. methyl methacrylate, acrylonitrile or styrene. Polyacrylonitrile is preferred. The particle sizes of the matting agents used according to the invention are in the range of from 1 to 15 μm, and preferably 50% of the particles of matting agent should have a size of from 4 to 7 μm. A particularly preferred particle size is in the range of from 2.5 to 3.5 μm. Particles of matting agents of this size ensure excellent reproduction of identifying features applied by printing techniques down to the finest detail (wavy lines produced by engraving with a rose engine) and facilitate clear writing on the information carrier with the usual writing pens.

The matting agents are advantageously added to the casting solution for the gelatine layers in the form of aqueous dispersions.

Matting agents are not essential for internal gelatine layers, but if their presence in such layers should be desirable, for example for the production and processing of the information carrier, they may be incorporated in these layers without impairing the quality of the finished document.

If applied to the outer layers, matting agents may render the layers cloudy so that a silver image developed below a layer containing matting agent may appear to be covered by a milky fog. This may be corrected by adding to the outer layer small quantities of polycarbocyclic aromatic sulphonic acid or their water-soluble salts, as described in Belgian Pat. No. 738,856.

Based on the gelatine content of the dry layers, the gelatine layers of the information carrier contain from 10 to 50% by weight of polymer (dry weight), preferably from 25 to 40% by weight.

If the gelatine layers are in addition to contain a matting agent, the latter would be used in a quantity of from 15 to 40% by weight, preferably from 20 to 30% by weight, based on the gelatine content of the dry layer.

The gelatine layers of the information carrier may also contain the usual additives for photographic layers, such as hardeners, e.g. formaldehyde, mucochloric acid, triacrylic formal, triazine hardeners, epoxide compounds, aziridines, vinyl sulphonyl compounds, carbodiimides or hardeners of the type of carbamoylonium compounds and carbamoyloxypyridinium compounds; hardening accelerators, e.g. resorcinol, polyvinyl lactams and polyvinyl lactones such as poly-N-vinylpyrrolidone and polyvinyl-2-oxazolidone as anti-fogging agents, anti-static agents such as poly-alkylene compounds, polyoxyalkylene esters of fatty acids, e.g. polyoxyethyleneglycol (molecular weight about 300), oleic acid esters, urethanes or esters of alkoxylated hydroxyl compounds such as those described in German Pat. No. 706,563, or alkali metal, alkaline earth metal or ammonium salts of inorganic acids or of organic sulpho- or carboxylic acids. The gelatine layers may also contain the usual coating auxiliaries or wetting agents, such as saponin, dialkylsulphosuccinic acid salts, salts of alkylsulphonic acids or of alkylarylpolyether sulphonic acids, carboxalkylated polyethylene glycol ethers or esters or fluorine-containing organic wetting agents of known structure, in particular perfluorinated carboxylic or sulphonic acids or salts thereof.

The information carrier will generally consist of a photographic material having the usual composition i.e. a material containing a light-sensitive silver halide emulsion layer on a conventional layer support. The information of silver or dye contained in this layer is produced by conventional image-wise exposure and photographic processing. The materials used as information carriers may be either photographic paper or film which may contain black-and-white or colour photographic marks, images and/or signs and/or other information or identifying features. The layer support of such photographic information carriers may consist of the usual materials used in commercial or picture photography. The following are examples: paper, paper equipped with reflection layers, polyolefine laminated paper and the usual film supports, e.g. of cellulose triacetate or polyesters, optionally in the form of opaque, pigmented layer supports. The photographic emulsion or auxiliary layers of such information carriers have the usual compositions used in photographic materials.

Layers based on non-sensitized silver halide emulsions or on spectrally sensitized silver halide emulsions may be mentioned as examples of light-sensitive photographic layers with which the information carrier may be equipped. This means that the known gelatine layers for the various black-and-white and colour photographic processes, negative, positive and diffusion transfer processes and printing processes are suitable. Gelatine is not the only binder which may be used in the photographic gelatine layers. Apart from gelatine, these layers may also contain chemically modified gelatine, e.g. acylated, acetylated, hydroxylated or esterified gelatine or gelatine which has been modified by graft polymerisation in known manner, or mixtures of gelatine with other hydrophilic colloids, e.g. with cellulose derivatives, polyvinyl alcohols, polyvinyl pyrrolidones, hydrolysed polyvinyl acetates, alginic acid, colloidal albumin or zein.

The polymers used for the layer support of the information carrier, e.g. the polymer with which the paper support is laminated or the one which the film support consists, including also cellulose esters, and the polymers of the foils used for laminating the information carrier should preferably be selected so that the softening point of the polymer of the layer support is lower than that of the foil material.

When polyolefine laminated paper is used as a layer support for the information carrier, it has been found advantageous to equip the paper with a polyolefine having a melting point which is lower by about 10° to 30° C. than the melting point of the foil carrying the adhesive layer on the foil material.

Before the information carrier is laminated with the other layers, it is marked with half-tone images and linear marks by imagewise exposure and photographic processing, e.g. a passport photograph and the corresponding printed and handwritten information.

In addition to such information, the information carrier may carry further security features or identifying features of various kinds which may be applied either photographically or by writing, printing or embossing. Data which can be read by machine, magnetically or optically, for example, may of course, also be applied. In this respect, the information carrier according to the invention differs in no way from the information carriers used in conventional documents.

Other safety features visible or invisible to the naked eye, e.g. substances absorbing UV light, may be incorporated in the information carrier, e.g. in the layer support, in which case, the features may be watermarks if the layer support is made of paper, or the features may be incorporated in the outer foil, e.g. in the composite foil. Various possibilities of incorporating such safety features in the tamper-proof documents have been described, for example, in the following publications: German Offenlegungsschriften Nos. 3 013 238, 1 446 851 and 2 908 742, U.S. Pat. No. 3,679,448, British Pat. No. 1 519 715, German Auslegeschrift No. 2 756 692 and U.S. Pat. Nos. 2,373,540 and 4,066,873.

Thermoplastic materials are suitable for use as transparent foils for laminating the information carrier e.g. polyethylene, polypropylene, cellulose esters, polyvinyl acetate, polystyrene, polyvinyl chloride, polyvinylidene chloride, polyvinyl fluoride, polytetrahalogenethylene or polycarbonate, in particular one based on bisphenol A, a polyester, in particular one based on polyethylene and polybutylene terephthalate, or polyamides such as polyamide-6, polyamide-6,6 polyamide-12 or copolyamides.

So-called composite foils built up of individual foils, having the same or differing chemical compositions may, or course, also be used. The following are examples: polyethylene/polyamides, polypropylene/polyamides and combinations of polyolefine foils with other foil material such as polyesters, e.g. polyethylene terephthalate. Suitable foils and composite foils have been described in Ullmanns Encyklopädie der Technischen Chemie, 4th Edition, Volume 11, pages 673 et seq.

The thickness of the foils used according to the invention depends on the required stiffness of the document. Foil thicknesses of from 15 to 250 μm will generally be sufficient, and thicknesses of from 50 to 200 μm are preferred.

The surface of the foil intended to carry the layer of adhesive may be subjected to a pretreatment to improve the bond between the foil and the adhesive layer. Such a pretreatment should ensure more uniform application of the coating solution and increase the bond strength. Satisfactory results are obtained, for example, by the usual corona treatment.

Bonding of the adhesive layer applied to the carrier foil may, of course, also be assisted by other measures, e.g. the application of a suitable substrate layer.

The usual adhesive layers may be used for bonding the individual foils of a composite foil or for bonding the foil or composite foil to the information carrier but it is preferable to use the same adhesive substance for both purposes.

Suitable adhesive layers contain, for example, ethylenically unsaturated monomeric, oligomeric or polymeric, mainly $\alpha$, $\beta$-unsaturated compounds or vinyl group containing compounds which carry acrylate and/or methacrylate groups and which can be hardened by radical reactions. Such adhesive layers and their use have been described in German Offenlegungsschriften Nos. 2952322 and 3027759. Compounds of this type based on polyesters, $\alpha$, $\beta$-unsaturated polyesters, polyethers, polyepoxides, polyurethanes, urethane-modified polyepoxides, urethane-modified polyesters and urethane-modified polyethers are particularly suitable.

The adhesive layers described in German Offenlegungsschrift No. 3,130,071 which contain a poly-1,2-alkylene imine are also eminently suitable.

Application of the composition of adhesive layer to the foil may be carried out by the conventional methods employed in the lacquer industry, such as spraying, roller application, knife coating, printing, immersion, centrifuging, flooding, spread coating, brush coating, etc.

The dry thickness of the adhesive layer depends on the particular requirements and the adhesive effect to be produced. Layers having a dry thickness of from 0.05 to 50 $\mu$m are suitable in principle. Satisfactory results may already be obtained with layers having a dry thickness of from 0.05 to 10 $\mu$m. Dry thicknesses of from 0.05 to 2 $\mu$m are preferred for adhesive layers containing poly-1,2-alkyleneimine.

To laminate the foil which is covered with adhesive layer to the surface of the information carrier, the foil is heated to about 50° to 150° C. and pressed against the surface of the information carrier in such a manner that no bubbles or creases are formed in the laminate. Lamination is assisted by the application of pressure in the region of from 1 to 10 kp/cm$^2$. If the material of the adhesive layer is one which can be hardened by irradiation, as described, for example, in German Offenlegungsschrift No. 2,952,322, the document is generally exposed to high energy radiation, e.g. UV light, electron radiation or gamma radiation in addition to the heating described above after lamination has been completed.

UV light is used for adhesive layers which contain photo initiators.

Lamination, which is preferably carried out on both sides of the information carrier, may be carried out continuously by bringing the individual information carriers together with the foil covered with adhesive layer as the adhesive foil is run off supply rolls. The laminate thus obtained in the form of a band may then be punched out to remove the parts containing the information carrier, and the welded foil may then be severed at a distance of about 1 to 2 mm from the edge of the information carrier, depending on the thickness of the information carrier. The resulting object is an information carrier covered with layers which are sealed down on all sides so that subsequent welding of the edges is unnecessary. Discontinuous lamination using separate pieces of foil will, of course, produce the same result.

The documents described above are remarkably tamper-proof. The gelatine layers of the information carrier which have the composition according to the invention are surprisingly effective in reinforcing the bond betweeen the foils and the information carrier. Even with the application of heat and/or solvent, the document can no longer be taken apart without complete destruction of the information carrier.

A further important and unexpected advantage of the identification documents or cards according to the invention which contain polyalkyleneimine adhesive layers is that they lie completely flat. It is particularly in this respect that the documents according to the invention are superior to the known documents.

EXAMPLE 1

100 g of an aqueous 2% by weight polyethyleneimine solution were mixed with 0.1 g of glacial acetic acid and 2 ml of an aqueous 40% by weight formaldehyde solution and applied to a polyethylene foil. The surface of the polyethylene foil was exposed to corona irradiation before the mixture was cast on it. The dried layer contained 0.1 g of polyethyleneimine per m$^2$.

The information carrier used was a conventional photographic paper having a layer support consisting of paper weighing approximately 120 g/m$^2$ which was laminated with polyethylene on both sides. The softening point of the polyethylene of the layer support was 110° C. After corona irradiation on both sides, the layer support was covered with a light-sensitive silver halide-gelatine-emulsion layer, a protective layer containing gelatine and a backing layer.

The silver halide emulsion layer was based on a photographic black-and-white emulsion of conventional composition. The layer contained 3.5 g of gelatine and 1.2 g of polyethylacrylate (particle size about 0.05 $\mu$m) per m$^2$ and the usual additives, e.g. wetting agents and hardeners. The thickness of the dry layer was 4.7 $\mu$m. A protective layer containing per m$^2$ 1.2 g of gelatine, 0.45 g of polyethylacrylate, and 0.3 g of polyacrylonitrile having a particle size of about 3 $\mu$m was placed over the silver halide emulsion layer. The thickness of the dry layer was 1.95 $\mu$m.

A layer containing 1.8 g of gelatine, 0.65 g of polyethylacrylate, 0.45 g of polyacrylonitrile and 0.005 g of potassium nitrate per m$^2$ was applied to the back of the layer support. The thickness of the dry layer was 2.9 $\mu$m.

A photograph of the owner of the identification document together with the necessary information was produced by exposure of the information carrier and developing and fixing of the material, and, after drying, the information carrier was covered on both sides with a rose engine engraving.

The information carrier now carrying the photographic and printed identifying features was placed between two of the above mentioned polyethylene foils which had a softening point of about 122° C. The adhesive layers of the foils were thus brought into contact with the two surfaces of the information carrier while the foils projected by about 1 mm over the edges of the information carrier. The packet was then passed between two rollers heated to 90° C. and pressed together at a pressure of about 1.5 kp/cm$^2$.

After cooling of the document, the polyethylene foils were so firmly bonded to the information carrier that when an attempt was made to separate the components of the document in the heated state (about 100° C.) after the edges had been cut off, the paper support of the information carrier was destroyed but its remnants adhered firmly to the foils which were also irreversibly stretched. The bond between foil and surface of information carrier could not be dissolved even by treatment with hot water or with solvents such as chloroform, petroleum hydrocarbons, acetic acid or dilute hydrochloric acid.

EXAMPLE 2

The solution of adhesive layer described in Example 1 was applied to a polyethylene terephthalate foil which had been treated by corona irradiation, and the foil with the adhesive layer on it was passed between two rollers heated to 90° C. together with a corona-irradiated polyethylene foil under a pressure of 5 kp/cm$^2$ so that the foils were bonded together to form a composite foil.

The information carrier was a photographic film material containing a layer support of cellulose triacetate pigmented with titanium dioxide and equipped with the usual substrate layers, a silver halidegelatine emulsion layer, a protective gelatine layer above the said emulsion layer and a gelatine backing layer.

The composition of the three gelatine layers was that indicated in Example 1.

A photograph of the owner of the document together with the corresponding information was produced on this information carrier by exposure, development of the material and fixing and drying, and both sides were finally engraved with rose engine marks.

To produce the document, the polyethylene surface of the composite foil was coated with the same adhesive layer composition as that used for the production of the composite foil and it was then laminated to the information carrier as described in Example 1.

A very flat-lying indentification card was obtained. The indentification document can no longer be taken apart without complete destruction of the photographic material used as information carrier.

EXAMPLE 3

Example 2 was repeated but in this case the polyethylene acrylate in the three gelatine layers was replaced by a corresponding quantity of gelatine.

Bonding of the foils to the surface of the information carrier was unsatisfactory. Steam or solvent vapours could be used to expose the surface of the information carrier virtually undamaged.

We claim:

1. A tamper-proof document consisting of a support and a layer on the support containing gelatin and at least 10% by weight of particles smaller than 0.1 μm of a homo- or copolymer of an acrylic and/or methacrylic acid ester together with an emulsion having a photographic silver or dye image associated with the gelatin layer and at least the gelatin layer being covered with a transparent foil tightly adherent to the gelatin layer having an adhesive laminated on the foil and adhearing to the gelatin layer, characterized by having a weld wherein the adhesive layer on the foil is adhered to the gelatin layer and the document that cannot be taken apart without destruction of the emulsion.

2. A document according to claim 1, characterized in that the acrylic acid ester and the methacrylic acid ester are a $C_1$ to $C_{12}$ alkyl acrylate and a $C_1$ to $C_{12}$ alkyl methacrylate.

3. A document according to claims 1 or 2, characterized in that the homo- or copolymer particles have a size of from 0.01 to 0.07 μm.

4. A document according to claims 1 or 2, characterized in that the gelatine-containing layers of the information carrier contain, based on the gelatine content of the layer, from 25 to 40% by weight of the homo- or copolymer and optionally from 20 to 30% by weight of a matting agent.

5. A tamper-proof document consisting of a support, an information carrier on the support in the form of a photographic material carrying information comprising at least one gelatin layer carrying a photographic silver or dye image and a first outer gelatin-containing layer covering the image carrying layer and a second outer gelatin-containing layer covering the reverse side of the support, said outer gelatin-containing layers each containing gelatin and at least 10% by weight of particles smaller than 0.1 μm of a homo- or copolymer of an acrylic and/or methacrylic acid ester and the gelatin layers being covered with transparent foils having an adhesive laminated on the foils and adhering to the gelatin layers, characterized by having a weld wherein the adhesive layers on the foils is adhered to the gelatin layers and the document that cannot be taken apart without destruction of the emulsion.

6. A document according to claim 5, characterized in that, in addition, a matting agent is contained in at least the two outer gelatine-containing layers.

7. A document according to claim 6, characterized in that the matting agent has a particle size of from 2.5 to 3.5 μm.

8. A document according to claim 7, characterized in that the matting agent is polyacrylonitrile.

9. A tamper-proof document consisting of a support, an information carrier on the support in the form of a photographic material carrying information comprising at least one gelatin layer carrying a photographic silver or dye image and an outer gelatin-containing layer covering the image carrying layer and containing at least 10% by weight of particles smaller than 0.1 μm of a homo- or copolymer of an acrylic and/or methacrylic acid ester and at least the outer gelatin layer being covered with a transparent foil tightly adherent to the outer gelatin layer having an adhesive laminated on the foil and adhering to the said gelatin layer, characterized by having a weld wherein the adhesive layer on the foil is adhered to the gelatin layer and the document that cannot be taken apart without destruction of the image carrying layer.

10. A tamper-proof document consisting of a support comprised of a polyolefin laminated paper and a layer on the support containing gelatin and at least 10% by weight of particles smaller than 0.1 μm of a homo- or copolymer of an acrylic and/or methacrylic acid ester together with an emulsion having a photographic silver or dye image associated with the gelatin layer and at least the gelatin layer being covered with a transparent foil having a melting point of 10° to 30° C. higher than the melting point of the polyolefin, said foil being tightly adherent to the gelatin layer having an adhesive laminated on the foil and adhering to the gelatin layer, characterized by having a weld wherein the adhesive layer on the foil is adhered to the gelatin layer and the document that cannot be taken apart without destruction of the emulsion.

* * * * *